United States Patent [19]

Wright

[11] 4,047,941

[45] Sept. 13, 1977

[54] DUPLEX FERRIT IC-MARTENSITIC STAINLESS STEEL

[75] Inventor: Roger N. Wright, Elnora, N.Y.

[73] Assignee: Allegheny Ludlum Industries, Inc., Pittsburgh, Pa.

[21] Appl. No.: 671,901

[22] Filed: Mar. 29, 1976

Related U.S. Application Data

[63] Continuation-in-part of Ser. No. 508,376, Sept. 23, 1974, abandoned.

[51] Int. Cl.[2] ..... C22C 38/38

[52] U.S. Cl. ..... 75/126 B; 148/37

[58] Field of Search ..... 75/126 B, 126 D, 126 F; 148/37

[56] References Cited

U.S. PATENT DOCUMENTS

| | | | |
|---|---|---|---|
| 1,920,953 | 8/1933 | Becket | 75/126 B |
| 2,138,289 | 11/1938 | Becket | 75/126 B |
| 2,156,299 | 5/1939 | Leitner | 75/126 B |
| 2,183,715 | 12/1939 | Franks | 75/126 F |
| 2,478,105 | 8/1949 | Joliuet | 75/126 D |
| 2,597,173 | 5/1952 | Patterson | 75/126 B |
| 3,499,802 | 3/1970 | Lagneborg | 148/37 |
| 3,713,812 | 1/1973 | Brickner | 75/126 B |
| 3,832,244 | 8/1974 | Pinnow | 148/37 |
| 3,847,600 | 11/1974 | Mimino | 75/126 F |
| 3,861,908 | 1/1975 | Bressanelli | 75/126 B |
| 3,926,685 | 12/1975 | Gueussier | 148/37 |

FOREIGN PATENT DOCUMENTS

| | | | |
|---|---|---|---|
| 892,463 | 3/1962 | United Kingdom | 75/126 B |

*Primary Examiner*—Arthur J. Steiner

*Attorney, Agent, or Firm*—Vincent G. Gioia; Robert F. Dropkin

[57] ABSTRACT

A ferritic-martensitic duplex stainless steel having properties between those of ferritic and martensitic stainless steels. The steel consists essentially of, by weight, from 11.0 to 20.5% chromium, from 1.0 to 6.5% manganese, from 0.005 to 0.1% carbon, balance essentially iron. The steel is additionally characterized by chromium and manganese contents within Area ABCD of the Figure, and by a chromium equivalency of from 5.0 to 11.0, in accordance with the following equation:

$$\text{Chromium Equivalency} = \%Cr + 5(\%Si) + 4(\%Mo) + 12(\%Al) - 40(\%C + \%N) - 2(\%Mn) - 3(\%Ni) - \%Cu$$

5 Claims, 1 Drawing Figure

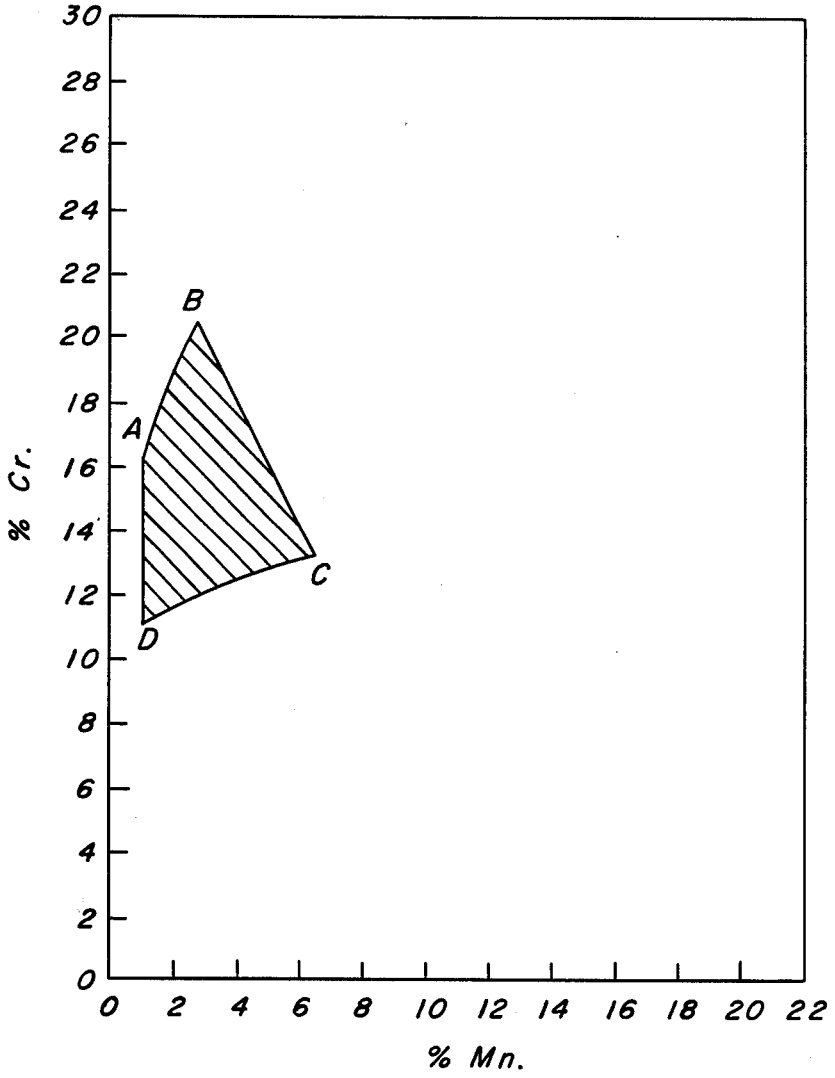
30
28
26
24
22
20
18
16
14
12
10
8
6
4
2
0
% Cr.
A
B
C
D
0 2 4 6 8 10 12 14 16 18 20 22
% Mn.

DUPLEX FERRIT IC-MARTENSITIC STAINLESS STEEL

This application is a continuation-in-part of now abandoned copending application Ser. No. 508,376, filed Sept. 23, 1974.

The present invention relates to a duplex ferritic-martensitic stainless steel.

Stainless steels are generally characterized as being austenitic, ferritic and martensitic. Of them, austenitic steels most often possess the best combination of physical properties and corrosion resistance. Less costly, ferritic and martensitic steels do, however, possess excellent properties for many applications. Ferritic steels usually have an as-annealed tensile strength of from 60 to 80 ksi, and an as-annealed ductility of from 25 to 35% elongation in 1 inch. Martensitic steels, on the other hand, usually have an as-annealed (supercriticaly with subsequent quenching) tensile strength of from 175 to 200 ksi, and an as-annealed ductility of from 15 to 18% elongation in 1 inch.

As a wide gap exists between the properties of ferritic and martensitic steels, attempts have been made to develop steels having properties therebetween. One such attempt which has met with some success, utilizes post-anneal heat treatments. Post-anneal heat treatments do, however, produce properties which can be destroyed through subsequent processing: e.g. welding. Moreover, post-anneal heat treatments are often costly and inconvenient.

The present invention provides a steel having properties between those of ferritic and martensitic stainless steels; and achieves said result by carefully controlling the amounts of the elements forming the steel. The desired result is not dependent upon post-anneal heat treatments. In fact, the steel of the present invention is acutally a duplex ferritic-martensitic stainless steel. It consists essentially of chromium, manganese, carbon, and iron.

An attempt at producing a duplex ferritic-martensitic stainless steel is described in an article written by Hayden and Floreen (Metallurgical Transactions, 1970, Volume 1, pages 1955 - 1959). Said work involved Fe-Cr-Ni alloys and not Fe-Cr-Mn alloys. Alloys studied ranged from a nearly completely ferritic 23.9% Cr - 2.85% Ni steel through certain duplex compositions to a nearly completely martensitic 16.5% Cr - 5.54% Ni steel.

It is accordingly an object of the present invention to provide an Fe-Cr-Mn duplex ferritic-martensitic stainless steel.

The foregoing and other objects of the invention will be best understood from the following description, reference being had to the accompanying FIGURE which illustrates the relationship between chromium and manganese for the steel of the subject invention.

The present invention provides a duplex ferritic-martensitic stainless steel which consists essentially of, by weight, from 11.5 to 20.5% chromium, from 1.0 to 6.5% manganese, from 0.005 to 0.1% carbon, balance essentially iron. As to its duplex structure, the steel contains at least 5% ferrite and at least 20% martensite. Levels of at least 10% ferrite and 30% martensite are, however, generally present.

Chromium and manganese contents should lie within Area ABCD of the FIGURE. Plotted chromium and manganese levels to the right of line, BC tend towards ferritic-austenitic steels. Levels above line AB and to the left of line AD tend toward ferritic steels; and those below line CD tend toward austenitic and/or martensitic steels. Preferred chromium and manganese contents are from 11.5 to 19% chromium and 1.5 to 5.5% manganese. Manganese contents are, however, generally in excess of 2.0%.

To further insure that the alloy of the subject invention has a duplex ferritic-martensitic structure, said alloy is melted to have a chromium equivalency of from 5.0 to 11.0, and preferably from 5.5 to 10.5, in accordance with the following equation:

$$\text{Chromium Equivalency} = \%Cr + 5(\%Si) + 4(\%Mo) + 12(\%Al) - 40(\%C + \%N) - 2(\%Mn) - 3(\%Ni) - \%Cu$$

Silicon, molybdenum, aluminum, nitrogen, nickel and copper are all residuals in the duplex steel of the subject invention.

The following examples are illustrative of several aspects of the invention.

EXAMPLE I

Two alloys (Alloys A and B), were prepared to demonstrate the present invention. The alloys were cast, hot rolled to thicknesses of 0.135 and 0.5 inch, and anealed at respective temperatures of 1300° and 1575° F for a time equal to 1 hour per inch of thickness. The alloys were then air cooled and pickled. Their chemistry appears hereinbelow in Table I.

TABLE I.

| | Chemistry (wt. %) | | | | | | | | | |
|---|---|---|---|---|---|---|---|---|---|---|
| Alloy | Cr | Mn | C | Si | Mo | Al | N | Ni | Cu | Fe |
| A | 12.45 | 3.03 | 0.015 | 0.20 | 0.10 | 0.02 | 0.015 | 0.23 | 0.11 | Bal. |
| B | 13.45 | 2.55 | 0.015 | 0.20 | 0.10 | 0.02 | 0.015 | 0.23 | 0.11 | Bal. |

Microscopic examinations of specimens of Alloys A and B revealed that Alloy A contained from 5 to 10% ferrite and Alloy B from 15 to 20% ferrite. The balance of both alloys was essentially martensitic.

The chromium equivalency for Alloys A and B appears hereinbelow in Table II.

TABLE II.

| Alloy | Chromium Equivalency |
|---|---|
| A | 6.0 |
| B | 8.0 |

As noted hereinabove, the steel of the subject invention has a chromium equivalency of from 5.0 to 11.0.

Specimens of Alloys A and B were tested for tensile strength and elongation. The results of the tests appear hereinbelow in Table III, along with the specimen's gage and annealing temperature.

TABLE III.

| Alloy | Annealing Temperature (° F) | Gage | Ultimate Tensile Strength (ksi) | Elongation In One Inch(%) |
|---|---|---|---|---|
| A | 1300 | 0.5 | 103.9 | 26.0 |
| A | 1300 | 0.135 | 87.3 | 26.0 |
| B | 1575 | 0.5 | 124.2 | 22.0 |

TABLE III.-continued

| Alloy | Annealing Temperature (° F) | Gage | Ultimate Tensile Strength (ksi) | Elongation In One Inch(%) |
|---|---|---|---|---|
| B | 1575 | 0.135 | 127.9 | 18.5 |

It is evident from the data appearing hereinabove, that the physical properties of the duplex ferritic-martensitic stainless steel of the present invention are intermediate those of ferritic and martensitic stainless steels. Ferritic steels as noted hereinabove, usually have an as-annealed tensile strength of from 60 to 80 ksi, and an as-annealed ductility of from 25 to 35% elongation in 1 inch. Martensitic steels, on the other hand, usually have an as-annealed tensile strength of from 175 to 200 ksi, and an as-annealed ductility of from 15 to 18% elongation in 1 inch.

Additional specimens of Alloys A and B were tested for their Charpy V-Notch impact transition temperature. The results of the test appear hereinbelow in Table IV.

TABLE IV.

| Alloy | Annealing Temperature (° F) | Gage | Impact Transition Temperature (° F) |
|---|---|---|---|
| A | 1300 | 0.5 | −100 |
| A | 1300 | 0.135 | −175 |
| B | 1575 | 0.5 | −50 |
| B | 1575 | 0.135 | −175 |

Evident from the low impact transition temperatures is the toughness of the alloy of the subject invention.

EXAMPLE II

Two additional alloys (Alloys C and D), were prepared. The alloys were processed in a manner which paralleled that for Alloy B and; basically differed from Alloy A only in annealing temperature. The chemistry of Alloys C and D appears hereinbelow in Table V.

TABLE V.

| Alloy | Chemistry (wt. %) | | | | | | | | | | |
|---|---|---|---|---|---|---|---|---|---|---|---|
| | Cr | Mn | C | Ti | Si | Mo | Al | N | Ni | Cu | Fe |
| C | 8.99 | 3.16 | 0.008 | 0.18 | 0.20 | 0.055 | 0.025 | 0.004 | 0.023 | 0.10 | Bal. |
| D* | 16.5 | 3.20 | 0.01 | 0.20 | 0.20 | 0.06 | 0.025 | 0.005 | 0.25 | 0.10 | Bal. |

*Aim analysis

Microscopic examinations of specimens of Alloys C and D revealed that Alloy C was essentially martensitic and that Alloy D was essentially ferritic.

The chromium equivalency for Alloys C and D appears hereinbelow in Table VI.

TABLE VI.

| Alloy | Chromium Equivalency |
|---|---|
| C | 4.2 |
| D | 11.6 |

Note that the chromium equivalency for Alloys C and D is outside the range of the subject invention. As noted hereinabove, Alloy C is essentially martensitic, and Alloy D is essentially ferritic.

Specimens of Alloys C and D were tested for tensile strength and elongation. The results of the tests appear hereinbelow in Table VII.

TABLE VII.

| Alloy | Gage | Ultimate Tensile Strength (ksi) | Elongation in One Inch(%) |
|---|---|---|---|
| C | 0.130 | 104.2 | 13 |
| D | 0.130 | 61.3 | 32 |

The poor elongation of Alloy C and the low strength of Alloy D is readily evident from an examination of Table VII. A comparison of Table III and Table VII clearly demonstrates the combination of properties attainable with alloys within the subject invention, as contrasted to those attainable with essentially martensitic or ferritic alloys.

Additional specimens of Alloys C and D were tested for their Charpy V-Notch impact transition temperature. The results of the test appear hereinbelow in Table VIII.

TABLE VIII.

| Alloy | Gage | Impact Transition Temperature (° F) |
|---|---|---|
| C | 0.130 | 0 |
| D | 0.130 | −50 |

From a comparison of Tables IV and VIII, it is evident that the essentially martensitic and ferritic alloys did not have as low of an impact transition temperature as did the alloys of the subject invention.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A ferritic-martensitic duplex stainless steel consisting essentially of, by weight, from 11.0 to 20.5% chromium, between 2.0 and 6.5% manganese, from 0.005 to 0.1% carbon, balance essentially iron; said steel being additionally characterized by chromium and manganese contents within Area ABCD of the FIGURE; said steel being further characterized by a chromium equivalency of from 5.0 to 11.0, in accordance with the following equation:

$$\text{Chromium Equivalency} = \%Cr + 5(\%Si) + 4(\%Mo) + 12(\%Al) - 40(\%C + \%N) - 2(\%Mn) - 3(\%Ni) - \%Cu;$$

silicon, molybdenum, aluminum, nitrogen, nickel and copper being residuals, said steel having at least 5% ferrite and at least 20% martensite, said steel having an as-annealed tensile strength between 80 and 175 ksi and an as-annealed ductility between 18 and 25% elongation in 1 inch.

2. A stainless steel according to claim 1, having from 11.5 to 19% chromium and no more than 5.5% manganese.

3. A stainless steel according to claim 1, having a chromium equivalency of from 5.5 to 10.5.

4. A stainless steel according to claim 1, having at least 10% ferrite and at least 30% martensite.

5. A stainless steel according to claim 1, having from 11.5 to 19% chromium and no more than 5.5% manganese; at least 10% ferrite and 30% martensite, and; a chromium equivalency of from 5.5 to 10.5.

* * * * *